United States Patent [19]

Reichert et al.

[11] Patent Number: 4,575,076

[45] Date of Patent: Mar. 11, 1986

[54] ARM WRESTLING MACHINE

[76] Inventors: Guy W. Reichert, P.O. Box 441; Orvil L. Abshire, P.O. Box 671, both of Canton, Okla. 73724

[21] Appl. No.: 561,912

[22] Filed: Dec. 15, 1983

[51] Int. Cl.[4] ..... A63B 21/00

[52] U.S. Cl. ..... 272/130; 272/136; 272/142; 272/901

[58] Field of Search ..... 272/901, 902, DIG. 1, 272/DIG. 4, DIG. 5, 93, 116, 135, 136, 142, 130; 73/379-381; 273/1 GI, 1 GC

[56] References Cited

U.S. PATENT DOCUMENTS 3,059,476 10/1962 Spradlin ..... 272/901 X 3,982,757 9/1976 McDonnell ..... 272/136 X

*Primary Examiner*—Richard J. Apley

*Assistant Examiner*—William R. Browne

*Attorney, Agent, or Firm*—Dunlap, Codding & Peterson

[57] ABSTRACT

An arm wrestling machine including an operating arm pivotally mounted on a base and two assemblies for exerting forces on the operating arm urging the operating arm toward a vertical position. One assembly includes a spring connected between the operating arm and a spring support mounted on a screw for linear movement toward and away from the operating arm so that such assembly provides an adjustable, continuous force on the operating arm. The other assembly includes a pneumatic cylinder connected between the operating arm and the base and intermittently receiving bursts of compressed air from a valve that is mounted on the operating arm so that the case of the valve moves with the operating arm and having a weight attached to the valve member of the valve so that movement of the operating arm intermittently opens the valve.

11 Claims, 11 Drawing Figures

ARM WRESTLING MACHINE

BACKGROUND OF THE INVENTION

1. Field of the Invention

The present invention relates generally to entertainment devices of the type which test a user's strength and, more particularly, but not by way of limitation, to machines for simulating an arm wrestling opponent.

2. Brief Description of the Prior Art

Arm wrestling has long been a popular sport and, because of this popularity, has also long been a subject for invention. Various types of machines have been designed to enable an individual to engage in the sport without the need for a live opponent. For example, an early version of an arm wrestling machine is described in U.S. Pat. No. 496,094 issued Apr. 25, 1893 to Peloquin. This machine includes a shaft that carries a simulated human arm and is spring biased to provide a force against which the user of the machine works in turning the shaft.

In general, these machines have not enjoyed a popularity approaching the popularity of the sport itself largely because of an inability of the prior art arm wrestling machines to simulate the action that is a part of a live arm wrestling contest. An important part of this action consists of surges in the effort exerted by one participant in an attempt to catch his opponent off guard and thereby either win the match or place his opponent in an awkward position from which the opponent cannot recover. Without this element of surprise, an arm wrestling machine cannot generate the interest that is necessary to make them popular entertainment devices. Accordingly, since prior art machines exert only continuous forces, although perhaps varying the magnitude depending upon the position of the handle moved by the user, they have not come into widespread use.

SUMMARY OF THE INVENTION

The present invention provides an arm wrestling machine that realistically simulates a live opponent by providing for intermittent forces to be exerted on the operating arm which the user of the machine attempts to place in a pinned position; that is, a position paralleling a surface upon which the user rests his elbow in operating the machine. To this end, the present invention is comprised of a first biasing assembly that exerts a continuous force on the operating arm, tending to move the operating arm to a substantially vertical rest position, and a second biasing assembly that intermittently exerts a second force on the operating arm that also tends to move the arm toward the rest position. Thus, the surges of effort on the part of an arm wrestler are incorporated into the machine of the present invention to provide an action by the machine that closely resembles the efforts of a live opponent. In a preferred embodiment of the invention to be described herein, the first of the two biasing assemblies; that is, the biasing assembly that produces the continuous force, is comprised of a spring having one of its ends attached to the operating arm of the machine and having the other end attached to a spring support that can be moved on the base of the machine to vary the continuous force that the user of the machine must overcome. The second biasing assembly is comprised of a pneumatic valve having a case that is mounted on the operating arm of the arm wrestling machine and includes a shaft that can be turned to open and close the pneumatic valve. This shaft is positioned with respect to the operating arm of the machine so that the shaft extends horizontally and a weight is attached to the shaft to limit pivotation of the shaft about its horizontal axis. The weight is mounted on the valve shaft so that the valve will open for a preselected angle between a longitudinal axis of the operating arm and a longitudinal axis of the weight. In operation of the machine, the inlet port of the valve is connected to a source of compressed air and the outlet port of the valve fluidly communicates with a pneumatic cylinder that is connected between the machine base and the operating arm so that the pneumatic cylinder will exert a force on the operating arm tending to move the operating arm toward the rest position when compressed air is transmitted via the valve to the pneumatic cylinder. Thus, when the user of the machine pivots the operating arm toward the surface upon which he rests his elbow, in the manner of arm wrestling, the valve will be opened at some point during the pivotation to kick the operating arm back toward the rest position, thereby simulating a surge of effort on the part of a live opponent. Moreover, movement of the operating arm will cause the weight on the valve shaft to oscillate in the manner of a pendulum so that, once the action begins, additional spurts of air are transmitted to the pneumatic cylinder in a substantially random fashion. Thus, the arm wrestling machine of the present invention closely approximates the forces one would experience in meeting a live opponent who would occasionally exert extra effort in an attempt to surprise the person against whom he is matched.

An object of the present invention is to provide an arm wrestling machine which captures the element of surprise that is an important factor in an arm wrestling contest.

Another object of the present invention is to provide an arm wrestling machine that provides a realistic simulation of a live opponent.

Other objects, advantages and features of the present invention will become clear from the following detailed description of the preferred embodiment of the present invention when read in conjunction with the drawings and appended claims.

DESCRIPTION OF THE PREFERRED EMBODIMENT

Figure 1:
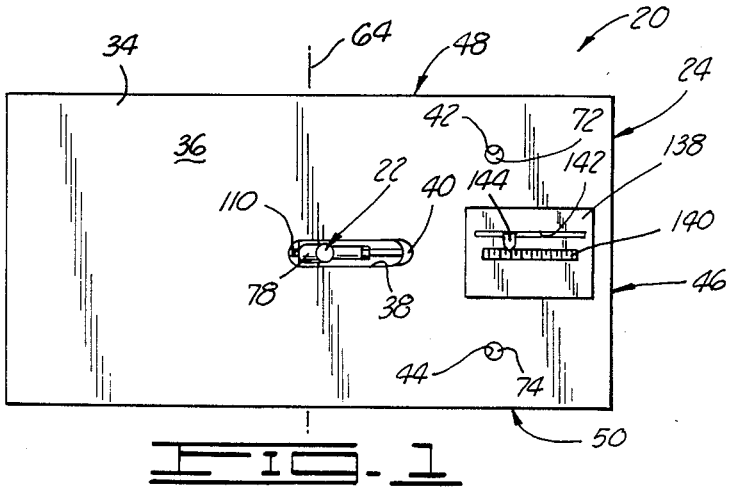
FIG. 1 is a plan view of an arm wrestling machine constructed in accordance with the present invention.
Figure 2:
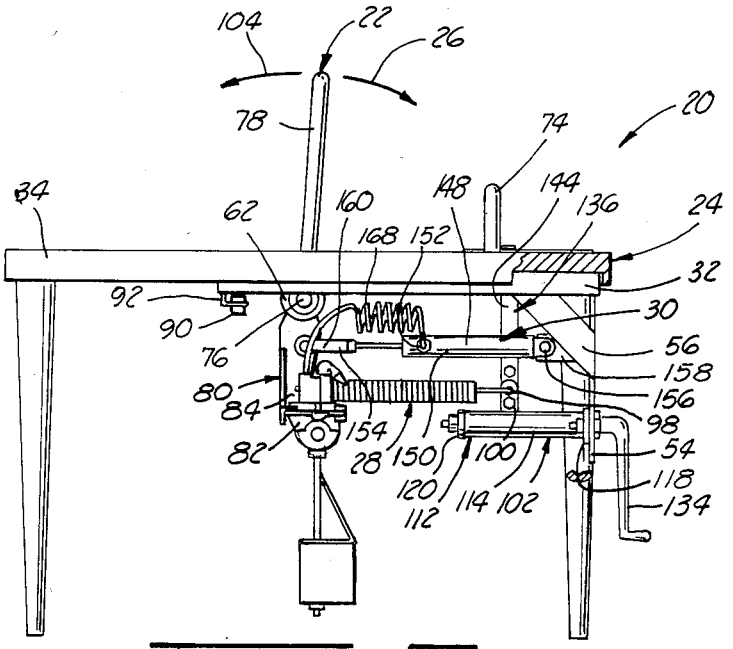
FIG. 2 is an elevational view in partial cutaway of one side of the arm wrestling machine shown in FIG. 1.

Referring now to the drawings in general and to FIGS. 1 and 2 in particular, shown therein and designated by the general reference numeral 20 is an arm wrestling machine constructed in accordance with the present invention. The arm wrestling machine 20 comprises an operating arm 22 that is pivotally supported on a base 24 for movement in a vertical arc, as indicated at 26 in FIG. 2, so that a user can place his elbow on the base 24, grasp the upper end of the operating arm 22, and work against the operating arm 22 in the same manner that he would work against the arm of a live opponent in an arm wrestling match. The operating arm 22 has a rest position, shown in FIG. 2, in which the arm 22 is substantially vertical and resistance to movement of the arm from the rest position, simulating the efforts of a live opponent, is provided by a first biasing assembly 28 and a second biasing assembly 30 to be discussed below.

Figure 4:
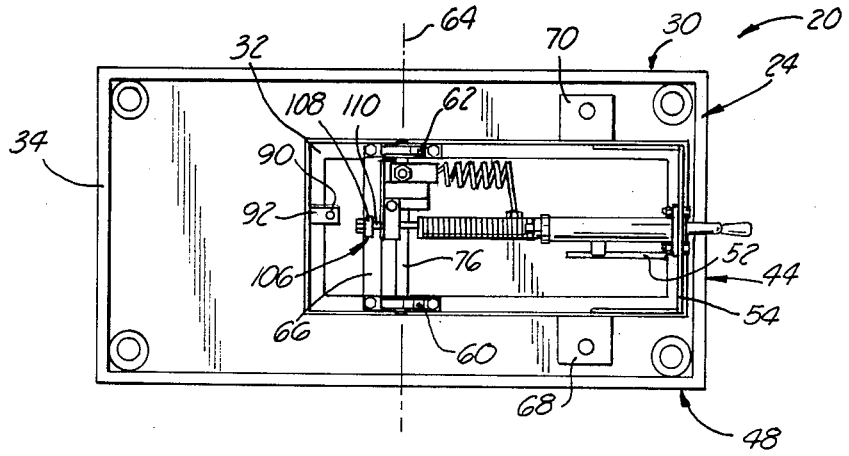
FIG. 4 is a bottom view of the arm wrestling machine.

The base 24 comprises a frame 32, particularly shown in FIGS. 2 and 4, which supports the operating arm 22 and the biasing assemblies 28, 30 and the frame 32 can be secured to the underside of a table top 34 by convention fasteners so that the upper surface 36 of the table top 34 provides a support for the user's elbow. For such mounting of the frame 32, an elongated slot 38, extending lengthwise of the table top 34 along the plane of the arc 26, is formed through central portions of the table top 34 so that a portion of the operating arm 22 can be extended above the upper surface 36 of the table top 34. As shown in FIG. 1, the operating arm 22 extends through the slot 38 near one end of the slot in the rest position of the operating arm and a champfer 40 is formed at the other end of the slot 38 so that the operating arm 22 can be moved along the arc 26 to a nearly horizontal position on the base 24 without interference from the table top 34.

In addition to the slot 38, circular holes 42, 44 are formed through the table top 34, the holes 42, 44 being displaced from the slot 38 toward the end 46 of the table top 34 toward which a user pivots the upper portions of the operating arm 22 and near the sides, 48 and 50 respectively, of the table top 34. A second elongated slot 52 (FIG. 4), extending lengthwise of the table 34 in the same manner as the slot 38 but disposed laterally of the slot 38 toward the side 48 and longitudinally of the slot 38 toward the end 46, is also formed through the table top 34. The purpose of the slot 52 and of the holes 42, 44 will become evident below.

Returning to the frame 32, such frame is preferably formed of angle stock welded into a rectangle as is particularly shown in FIG. 4. At one end of the frame 32, such end being disposed adjacent the end 46 of the table top 34, the base 24 also comprises a depending plate 54 that is welded to the frame 32 and braces 56, 58 are welded between the plate 54 and the frame 32 so that the plate 54 forms a rigid support for portions of the biasing assemblies 28, 30 to be discussed below.

Near the opposite end of the frame 32, pillow blocks 60, 62 are bolted to the frame 32 to support the operating arm 22 for pivotation about a horizontal axis 64 which has also been indicated in FIG. 1. As can be seen in FIG. 1, the axis 64 extends laterally of the table top 34 and the frame 32 is positioned so that the axis 64 will be longitudinally aligned with the end of the slot 38 farthest from the side 46 of the table top 34 to position the operating arm 22 relative to the table top 34 in the manner noted above. Bolted to the frame 32 with the pillow blocks is a strap 66 extending laterally across the frame 32 behind the pillow blocks 60, 62, as seen from the end 46 of the table top 34, for a purpose to be discussed below.

Between the pillow blocks 60, 62 and the plate 54, laterally extending plates 68 and 70 are welded to the frame 32 so as to underlie the holes 42 and 44 respectively that are formed through the table top 34 and hand holds 72 and 74 (FIGS. 5 and 6) are welded to the plates 68 and 70 to extend up through the holes 42 and 44. The hand holds 72, 74 are provided to enable the user of the machine 20 to brace his body while he pivots the operating handle 22; that is, he grasps one of the hand holds 72, 74 with the hand on one arm while moving the operating arm 22 with his other arm. In the preferred embodiment of the arm wrestling machine 20 shown in the drawings, the operating arm 22 is constructed in three parts. For mounting the arm 22 on the base 24, the arm 22 is comprised of a shaft 76 having one end supported in the pillow block 60 and the other end supported in the pillow block 62 so that the shaft 76 can rotate in the pillow blocks 60, 62 about its axis; that is, about the axis 64. Welded to the shaft 76 and extending through the slot 38 is a handle member 78 which is the portion of the operating arm 22 that is grasped by the user of the machine 20. The handle member 78 can conveniently be constructed of a length of steel pipe and such form of construction has been shown in the drawings.

Figure 7:
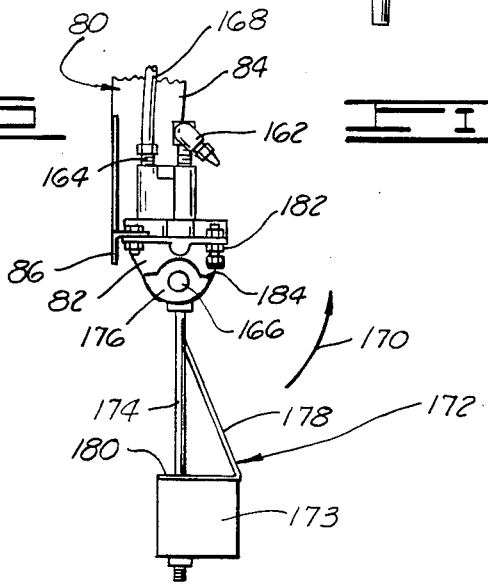
FIG. 7 is a side elevational view on an enlarged scale of a portion of the second biasing assembly of the arm wrestling machine.
Figure 8:
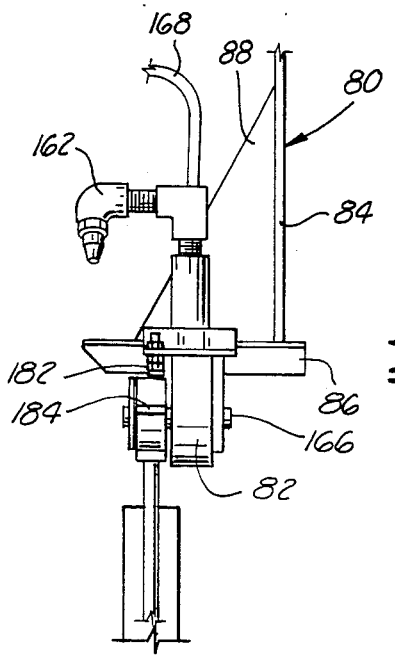
FIG. 8 is an end elevational view of the portion of the second biasing assembly shown in FIG. 7.

In addition to the operating handle 78 and shaft 76, the operating arm 22 further comprises a valve support member 80 which is welded to the shaft 76 and extends downwardly therefrom to provide for the connection of the operating arm 22 to the biasing assemblies 28, 30 and to further provide a mount for a pneumatic valve 82 that forms a portion of the second biasing assembly 30. To this latter end, and as particularly shown in FIGS. 7 and 8, the valve support member 80 is comprised of a plate 84 that is welded to the shaft 76, the plane of the plate 84 paralleling the plane of the operating arm pivotation arc 26, and a member 86 that is constructed of angle stock and is welded to the lower end of the plate 84 to extend laterally therefrom. The case of the valve 82 is then bolted to the angle stock member 86 as shown in FIGS. 7 and 8. In addition, the valve support member 80 further includes a triangular brace 88 attached between the plate 84 and the angle stock member 86 at the side of the plate 84 that is remote from the end 46 of the table top 34 toward which the user of the machine 20 pivots the handle member 78 of the operating arm 22. Such placement of the brace 88 permits the brace 88 to engage a push button switch 90 (FIGS. 2-4) mounted on a support arm 92 at the end of the frame 32 remote from the end 46 of the table top 34 when the handle member 78 has been pivoted to a nearly horizontal position. The switch 90 can thus be connected to a suitable signaling device to indicate that the user of the machine 20 has won the "match" with the arm wrestling machine 20.

Figure 3:
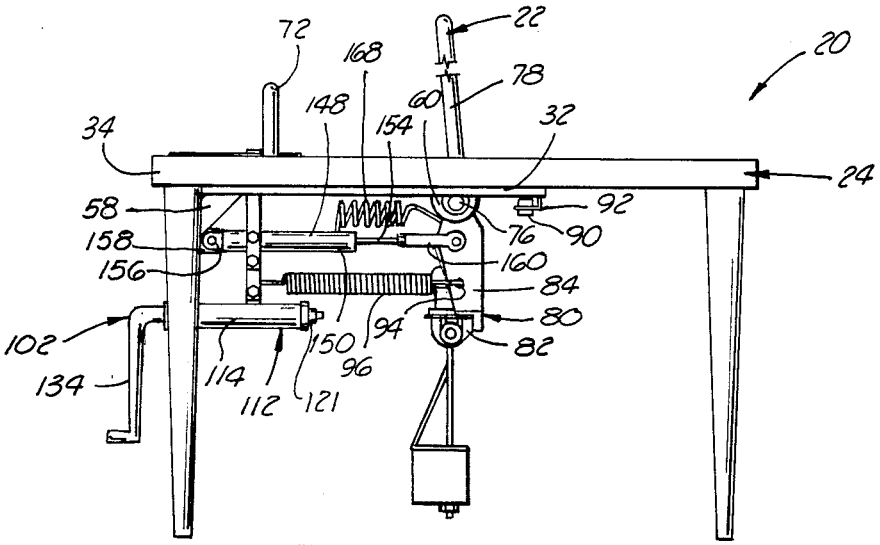
FIG. 3 is an elevational view of the other side of the arm wrestling machine.
Figure 5:
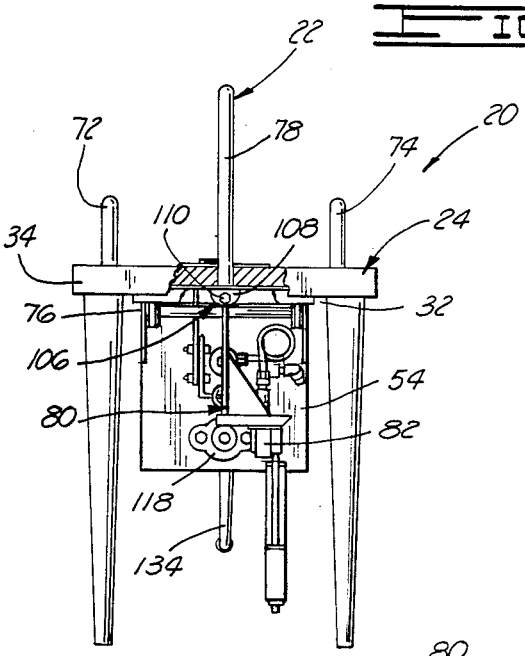
FIG. 5 is an elevational view in partial cutaway of one end of the arm wrestling machine.
Figure 6:
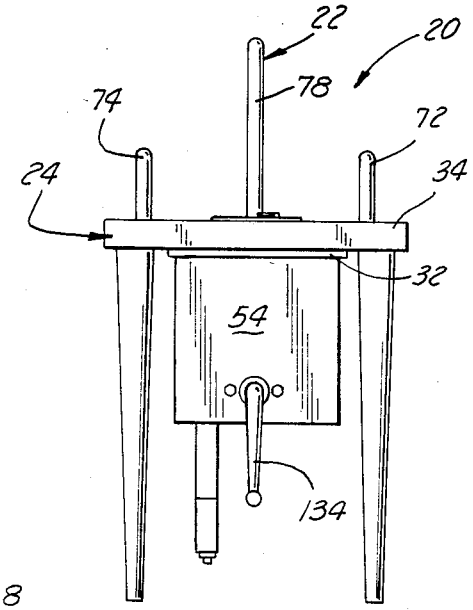
FIG. 6 is an elevational view of the other end of the arm wrestling machine.
Figure 9:
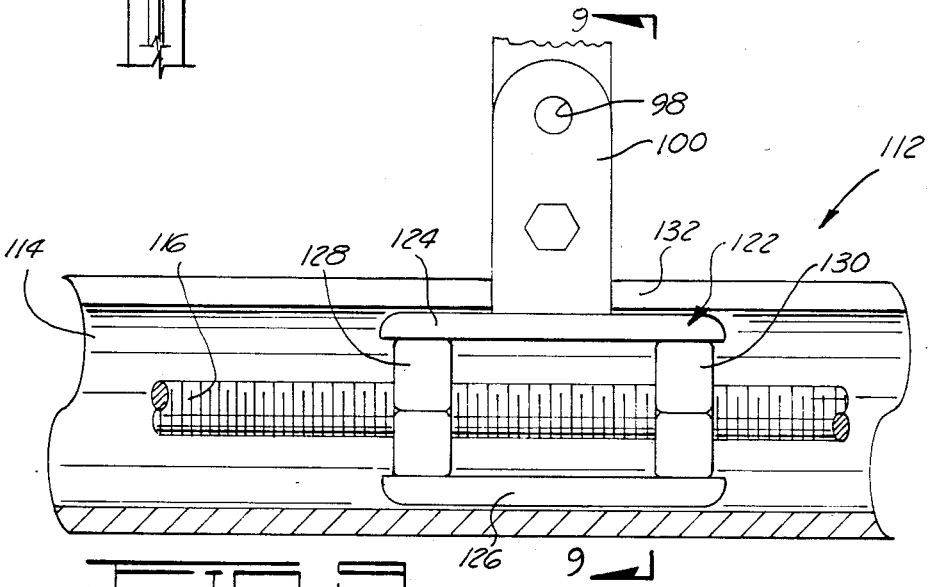
FIG. 9 is a cross section of a portion of the first biasing assembly of the arm wrestling machine.

As can be seen in FIG. 3, the plate 84 of the valve support member 80 has a hole 94 formed therethrough to receive a hook formed on one end of a coil spring 96 which forms a part of the first biasing assembly 28. A similar hook, at the other end of the spring 96, passes through a hole 98 (FIGS. 2 and 9) formed through a spring support 100 that forms a part of a force adjustment assembly 102 of which the first biasing assembly 28 is further comprised. As can be particularly seen in FIG. 2, the spring support 100 is positioned near the plate 54 that depends from the frame 32 so that the spring 96 will be placed in tension to exert a force on the operating arm 22 that will continuously urge the operating arm 22 to pivot in a direction 104 opposite the direction indicated by the pivotation arc 26. The rest position shown in FIG. 2 is then established by providing a stop 106 (FIGS. 1, 4 and 5) that will engage the handle member 78 of the operating arm 22, just below the table top 34, to limit pivotation in the direction 104. As shown in FIG. 4, the stop 106 can be conveniently constructed by welding a lug 108 to the strap 66 and passing a bolt 110 through a threaded hole in the lug 108, the lug 108 being positioned on a line with the operating arm 22, as shown in FIG. 5, for this purpose.

Figure 10:
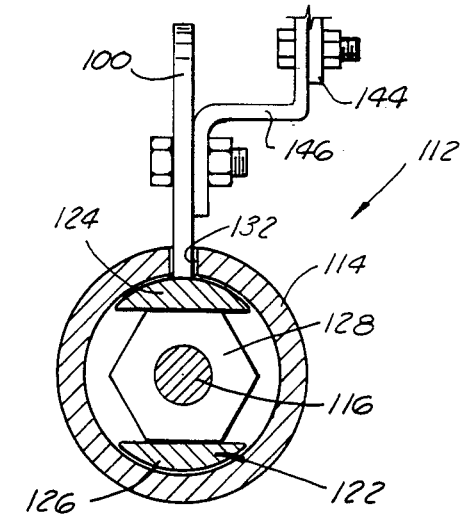
FIG. 10 is a cross section of the portion of the first biasing assembly shown in FIG. 9 taken along line 9—9 of FIG. 9.

In addition to the spring support 100, the force adjustment assembly comprises a spring support mounting assembly 112 that mounts the spring support 100 for linear movement toward and away from the operating arm 22 so that the force with which the spring 96 urges the operating arm 22 toward the rest position can be adjusted by the user of the arm wrestling machine 20. The spring support mounting assembly 112 is comprised of a tube 114 which contains a threaded rod 116 extending axially through the tube 114 as has been shown in FIGS. 9 and 10. One end of the tube is secured to a bearing block 118 (FIGS. 2 and 5), by means of which the spring support mounting assembly can be bolted to the depending plate 54, and the bearing block 118 and a bearing 120 at the other end of the tube 114 support the threaded rod 116 within the tube 114 for rotation about the axis of the tube 114. A collar 121 (FIG. 3) and handle 134, mounted on opposite ends of the rod 116 prevent axial movement of the rod 116 in the tube 114.

Internally of the tube 114, the spring support mounting assembly 112 comprises a carriage 122 to which the spring support is welded, the carriage 122 being conveniently formed by welding connectors 124, 126 to bolts 128, 130 threaded on the rod 116. The spring support 100 is welded to the connector 124 and extends out of the tube 114 through a slit 132 formed through the wall of the tube 114 so that the spring support 100 can be moved linearly along the tube 114 by turning the rod 116. Such turning of the rod 116 is accomplished by turning the handle 134 (FIGS. 2–6) that is mounted on the end of the rod 116 that passes through the bearing block 118.

Figure 11:
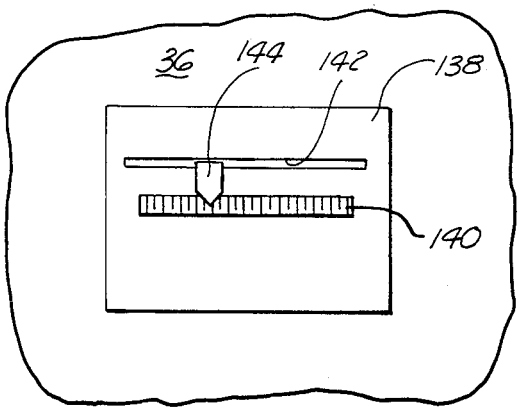
FIG. 11 is a plan view of a portion of the indicator assembly of the arm wrestling machine.

In the preferred form of the invention, the arm wrestling machine 20 further comprises an indicator assembly 136, portions of which are particularly shown in FIGS. 1, 2, 10 and 11. The indicator assembly 136 provides a measure of the force with which the first biasing assembly 28 urges the operating arm 22 toward the rest position of the arm 22 by indicating the maximum force the user must exert against the spring 96 to bring the operating arm 22 to the nearly horizontal position in which the operating arm engages the switch 90 to signal that the user has won the "match" with the arm wrestling machine. For this purpose, a scale plate 138, having a scale 140 marked or engraved thereon is adhered to the upper surface 36 of the table top 34, the scale plate 138 having a slot 142 formed therethrough parallel to the scale 140. The slot 142 is aligned with the slot 52 formed through the table top 34 so that a strap-like pointer 144 can be attached to the spring support 100 and extended upwardly therefrom to pass through the slots 52 and 142. In particular, the pointer 144 is bolted to a zigzag strap 146 (FIG. 10) that is, in turn, bolted to the spring support 100 so that the pointer 144 is displaced laterally of the biasing assemblies 28, 30 to clear such assemblies which, as shown in the drawings, are arranged in vertical alignment and in alignment with the operating arm 22. As shown in FIG. 11, upper portions of the pointer 144 are bent to overlay the scale 140 and are provided with a pointed end to facilitate reading of the scale 140.

Coming now to the second biasing assembly 30, such assembly is comprised of the valve 82 and a pneumatic cylinder 148 shown in FIGS. 2 and 3. The cylinder 148 is of the single acting type that includes a tubular body 150 having an inlet port 152 near one end thereof to receive compressed air and a piston (not shown) within the body 150 to be moved in response to compressed air introduced into the inlet port 152. The piston is connected to a piston rod 154 so that the piston rod will be extended from, or retracted into, the cylinder body 150 as the piston moves in the body 150.

In the arm wrestling machine 20, the end of the tubular body 150 of the cylinder 148 opposite the end whereon the inlet port 152 is disposed is pinned to the base 24 via a clevis 156 on the tubular body 150 and a lug 158 that is welded to the plate 54 and extends therefrom toward the operating arm 22. The piston rod 154 is similarly pinned to the plate 84 of the valve support member 80 via a clevis 160 so that compressed air introduced into the inlet port 152, at the end of the body 150 remote from the plate 54, will drive the piston and piston rod 154 of the cylinder 148 toward the plate 54 and thereby urge the operating arm 22 in the direction 104 shown in FIG. 2. Thus, the introduction of compressed air into the body of the cylinder 148 will urge the operating arm 22 toward the rest position thereof.

The valve 82, best shown in FIGS. 7 and 8, is of the type having an inlet port (not shown) into which compressed air can be introduced, an outlet port (not shown), and an operating member (not shown) which can be rotationally positioned within the case of the valve 82 to either internally connect the inlet and outlet ports or to open the outlet port to the ambient while closing the inlet port. A fitting 162, screwed into the inlet port of the valve 82, provides for the introduction of compressed air thereinto and a fitting 164 screwed into the outlet port similarly provides for transmission of compressed air from the valve 82. The valve member is mounted on a shaft 166 and the valve 82 is mounted on the valve support member 80 so that the shaft 166 will extend horizontally from the operating arm 22 and normally to the plane of pivotation of the operating arm 22 on the base 24 as can be seen by comparing FIGS. 2 and 8. A suitable valve having these characteristics is the model L111 pneumatic valve available from Webco Fluid Power Division of American Standard located in Lexington, Ky.

In the arm wrestling machine 20, the fitting 164 screwed into the outlet port of the valve 80 is connected to the inlet port 152 of the pneumatic cylinder 148 via a conduit 168 and the valve 82 is further mounted on the valve support member 80 of the operating arm 22 so that the valve 82 will internally connect the inlet and outlet ports thereof when the shaft 166 is turned in the direction 170 shown in FIG. 7 from a position in which the valve 82 is closed to fluid flow therethrough. That is, the valve 82 can be opened and closed by turning the shaft 166 about an axis 171 that extends laterally of the support arm 22. Thus, as can be seen by comparing FIGS. 2 and 7, the valve 82 can be opened to fluid flow therethrough by pivoting the operating arm 22 along the arc 26 while restraining the shaft 166 against rotation. Such restraint is provided by a weight 172 comprised of a bob 173 that is mounted on a rod 174 which, in turn, is attached to a sleeve 176 mounted on the shaft 166. In preparing the arm wrestling machine 20 for use, the sleeve 176 is mounted on the shaft 166 so that, when the operating arm 22 is in the rest position and the weight 172 is directly below the valve 82; that is, when the longitudinal axis of the weight 172 coincides with the longitudinal axis of the operating arm 22, the shaft 166 will be positioned to close the valve 82 to fluid flow.

It has been found that the connection of the rod 174 to the bob 173 can result in a weak spot that can lead to damage of the machine 20 during the operation thereof; that is, the weight 172 tends to whip from side-to-side during operation of the machine 20 and the result can be a flexure of the rod 174 that gives rise to metal fatigue and eventual fracture of the rod 174. To prevent this metal fatigue from occurring, a brace having a portion 178 that extends obliquely from the rod 174 and a portion 180 that overlays the bob 173 is welded to the rod as shown in FIG. 7, the portion 180 having a hole (not shown) formed therethrough for passage of the rod 174. The bob 173 is then mounted on the rod 174 by passing lower, threaded portions of the rod 174 through a hole (not shown) in the weight 172 and clamping the bob 173 between the portion 180 of the brace and a bolt screwed onto the lower end of the rod. The whipping motion of the weight 172 which, though a desirable feature of the arm wrestling machine 20 for reasons that will become clear below, is also controlled by a stop 182 mounted on the case of the valve to be engaged by a shoulder 184 on the sleeve 176. The stop 182, as has been shown, can be constructed by extending a bolt through one of the mounting holes of the valve case and using appropriately positioned nuts on such bolt to position the bolt head hear the shoulder 184.

OPERATION OF THE PREFERRED EMBODIMENT

A feature of the arm wrestling machine 20 is that the machine 20 is quickly and easily prepared for use. All that is required is that the fitting 162 be connected to a suitable source of compressed air and the switch 90 be connected in a circuit including suitable signaling devices; for example, lamps or bells, and an appropriate source of electrical power. The signaling devices can be mounted on the base 24 of the arm wrestling machine 20 so that the second of these connections will require no more than the insertion of a power plug into an electrical wall receptacle. Once these connections have been made, the machine 20 is ready for use.

The user of the arm wrestling machine 20 will initially select the force to be exerted on the operating arm 22 by the spring 96 of the first biasing assembly 28 to, in effect, select the strength of his opponent that is simulated by the machine 20. Such selection is made by turning the handle 134 while observing the movement of the pointer 144 on the scale 140 until a force suitable for the particular user is indicated on the scale 140. The user then seats himself adjacent one of the sides 48, 50 of the table top 34, places one elbow on the upper surface 36 thereof and grasps the operating arm 22 with the hand on the arm extending from such elbow. The other hand is used to grasp one of the hand holds 72, 74 to steady the user of the machine as he attempts to force the operating handle 22 along the arc 26 until the operating handle 22 is nearly parallel to the table top 34 as indicated by the closure of the switch 90 and the signaling devices connected thereto. The user can pit either arm against the machine 20 by his choice of the side 48, 50 of the machine adjacent which he seats himself. Thus, to pit his right arm against the machine 20, the user would sit adjacent the side 48, place his right elbow on the table top 36, grasp the operating arm 22 with his right hand and grasp the hand hold 72 with his left hand. Conversely, to pit his left arm against the machine 20, the user would sit adjacent the side 50, place his left elbow on the table top 36, grasp the operating handle 22 with his left hand, and grasp the hand hold 74 with his right hand.

With the user seated in either of the two positions described above and grasping the operating arm 22, the user will exert a force on the operating arm 22 in the manner that he would exert a force against the arm of a live opponent in an arm wrestling match. In response to such force, the operating arm 22 will commence movement in the direction indicated by the pivotation arc 26 and such movement will be opposed by a stretching of the spring 96 in the first biasing assembly 28. For a short distance of movement of the operating arm 22, the force exerted by the spring 96 will be the sole force opposing movement of the operating arm 22 toward the table top 36. However, after the operating arm 22 has moved a short distance along the pivotation arc 26, the reorientation of the case of the valve 82 while the shaft 166, and valve operating member connected thereto, are held in place by the weight 172 will cause the valve 82 to open to transmit compressed air from the fitting 162 to the fitting 164 and thence to the inlet port of the pneumatic cylinder 148. In response to the introduction of compressed air into the pneumatic cylinder 148, the piston rod 154 thereof is rapidly retracted into the tubular cylinder 150 to provide an additional force on the operating arm 22 tending to urge the operating arm 22 back to the rest position thereof shown in FIG. 2. Thus, the arm wrestling machine 20 simulates a sudden surge of force that is typical of the surges of the force that are exerted by live opponents.

Moreover, such surges are not discontinued once the user of the machine recovers from the surprise of this initial surge of force nor can he anticipate when the next surge will occur. When the operating arm 22 is initially kicked back toward the rest position thereof, the weight 172 will tend to take up oscillations in the manner of a pendulum so that the shaft 166 that is connected to the operating member of the valve 82 will have a tendency to take up periodic rotations with respect to the case of the valve 82. However, the periodicity of these oscillations is interrupted by engagement between the shoulder 184 on the sleeve 176 and the stop 182 that is mounted on the case of the valve 82. Since the forces between the shoulder 184 and the stop 182 will depend upon how the user of the machine exerts forces on the operating arm 22 and the manner in which the operating arm 22 and the weight 172 are moving at any time, the rotation of the shaft becomes a complicated function of time so that the valve 82 is opened and closed in a substantially random fashion. Thus, once the user has moved the operating arm 22 to a position to initially open the valve 82, the operating arm 22 will intermittently receive forces from the second biasing assembly 30 that simulate the same sort of random forces that would be exerted on the user's arm by a live opponent in a live arm wrestling match.

Should the user of the arm wrestling machine 20, despite the continuous force urged on the operating arm 22 by the first biasing assembly 28 and the intermittent forces exerted on the arm 22 by the second biasing assembly 30, succeed in forcing the operating arm 22 to a nearly horizontal position above the table top 34, the brace 88 of the valve support member 80 of the operating arm 22 will engage the switch 90 and close the switch 90 so that signaling devices connected thereto will indicate that the user of the machine has beaten his opponent simulated by the arm wrestling machine 20. Should the user decide that such simulated opponent was too easily beaten, he can easily increase the "strength" of such "opponent" by turning the handle 134 to draw the spring support 100 toward the plate 54 to increase the tension in the spring 96 of the first biasing assembly 28. Conversely, should the user of the machine find that he has taken on too "tough" an "opponent" he can similarly easily select an "opponent" with whom he is more equally matched by turning the handle 134 to move the spring support 100 away from the plate 54 and thereby decrease the tension in the spring 96.

It is thus clear that the present invention is well adapted to carry out the objects and attain the ends and advantages mentioned as well as those inherent therein. While a presently preferred embodiment of the invention has been described for purposes of this disclosure, numerous changes may be made which will readily suggest themselves to those skilled in the art and which are encompassed within the spirit of the invention disclosed as defined in the appended claims.

What is claimed is:

1. An arm wrestling machine, comprising:

a base;

an operating arm pivotally supported on the base for pivoting movement thereon away from a rest position of the operating arm;

first biasing means, connected between the base and the operating arm, for continuously urging the operating arm, when the latter is pivoted, toward said rest position; and second biasing means, connected below the base and to the pivoted operating arm, for intermittently urging the operating arm toward said rest position after a predetermined movement of said first biasing means.

2. The arm wrestling machine of claim 1 wherein the first biasing means is characterized as comprising means for adjusting the force with which the operating arm is continuously urged toward said rest position.

3. The arm wrestling machine of claim 2 wherein the first biasing means is further characterized as comprising a coil spring having one end thereof attached to the operating arm for exerting said force with which the operating arm is continuously urged toward said rest position; and wherein the means for adjusting the force with which the operating arm is continuously urged toward said rest position comprises:

a spring support attached to the other end of said coil spring; and means for mounting the spring support on the base for linear movement of the spring support toward and away from the operating arm, thereby adjusting the force the coil spring exerts on the operating arm.

4. The arm wrestling machine of claim 3 further comprising:

a scale mounted on the base; and a pointer attached to the spring support and having a portion thereof overlaying said scale.

5. The arm wrestling machine of claim 2 further comprising means for indicating the force with which the operating arm is continuously urged toward the rest position by the first biasing means.

6. The arm wrestling machine of claim 5 wherein the second biasing means comprises:

a pneumatic cylinder connected between the base and the operating arm for urging the operating arm toward the rest position thereon in response to compressed air introduced into said pneumatic cylinder;

a pneumatic valve having an inlet port to receive compressed air and an outlet port connected to said pneumatic cylinder, wherein the pneumatic valve is characterized as being of the type having a control member positionable to internally connect the inlet port of the pneumatic valve to the outlet port thereof and alternatively positionable to exhaust said outlet port; and means for intermittently positioning the control member of the pneumatic valve for internally connecting the inlet and outlet ports thereof.

7. The arm wrestling machine of claim 6 wherein the pneumatic valve is mounted on said operating arm; wherein the operating member of the valve is characterized as being rotationally positionable about an axis lateral to the operating arm for alternatively connecting the inlet and outlet ports of the pneumatic valve and exhausting the outlet port thereof; and wherein the means for intermittently positioning the control member of the pneumatic valve comprises a weight suspended from the control member of the pneumatic valve.

8. The arm wrestling machine of claim 2 wherein the second biasing means comprises:

a pneumatic cylinder connected between the base and the operating arm for urging the operating arm toward the rest position thereon in response to compressed air introduced into said pneumatic cylinder;

a pneumatic valve having an inlet port to receive compressed air and an outlet port connected to said pneumatic cylinder, wherein the pneumatic valve is characterized as being of the type having a control member positionable to internally connect the inlet port of the pneumatic valve to the outlet port thereof and alternatively positionable to exhaust said outlet port; and means for intermittently positioning the control member of the pneumatic valve for internally connecting the inlet and outlet ports thereof.

9. The arm wrestling machine of claim 8 wherein the pneumatic valve is mounted on said operating arm; wherein the operating member of the valve is characterized as being rotationally positionable about an axis lateral to the operating arm for alternatively connecting the inlet and outlet ports of the pneumatic valve and exhausting the outlet port thereof; and wherein the means for intermittently positioning the control member of the pneumatic valve comprises a weight suspended from the control member of the pneumatic valve.

10. The arm wrestling machine of claim 1 wherein the second biasing means comprises:

a pneumatic cylinder connected between the base and the operating arm for urging the operating arm toward the rest position thereon in response to compressed air introduced into said pneumatic cylinder;

a pneumatic valve having an inlet port to receive compressed air and an outlet port connected to said pneumatic cylinder, wherein the pneumatic valve is characterized as being of the type having a control member positionable to internally connect the inlet port of the pneumatic valve to the outlet port thereof and alternatively positionable to exhaust said outlet port; and means for intermittently positioning the control member of the pneumatic valve for internally connecting the inlet and outlet ports thereof.

11. The arm wrestling machine of claim 10 wherein the pneumatic valve is mounted on said operating arm; wherein the operating member of the valve is characterized as being rotationally positionable about an axis lateral to the operating arm for alternatively connecting the inlet and outlet ports of the pneumatic valve and exhausting the outlet port thereof; and wherein the means for intermittently positioning the control member of the pneumatic valve comprises a weight suspended from the control member of the pneumatic valve.

* * * * *

UNITED STATES PATENT AND TRADEMARK OFFICE

CERTIFICATE OF CORRECTION

PATENT NO. : 4,575,076

DATED : Mar. 11, 1986

INVENTOR(S) : Guy W. Reichert and Orvil L. Abshire

It is certified that error appears in the above-identified patent and that said Letters Patent is hereby corrected as shown below:

Col. 9, line 51, delete the word "pivoted".

Col. 9, line 52, after the word "the" insert --pivoted--.

Signed and Sealed this

Twelfth Day of January, 1988

*Attest:*

*Attesting Officer*

DONALD J. QUIGG

*Commissioner of Patents and Trademarks*